US007040568B2

(12) United States Patent
Lewis et al.

(10) Patent No.: US 7,040,568 B2
(45) Date of Patent: May 9, 2006

(54) DISPENSER FOR SHEET MATERIAL

(75) Inventors: Richard Paul Lewis, Marietta, GA (US); Paul Francis Tramontina, Alpharetta, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 10/817,513

(22) Filed: Apr. 2, 2004

(65) Prior Publication Data

US 2005/0224628 A1 Oct. 13, 2005

(51) Int. Cl.
*B65H 18/02* (2006.01)

(52) U.S. Cl. ..... 242/593; 242/132; 242/137; 242/615.3; 242/615.4; 206/409; 220/253

(58) Field of Classification Search ..... 242/593, 242/132, 137, 615.3, 615.4; 206/409, 390, 206/394, 205, 210, 812; 220/253; 221/1, 221/62, 63
See application file for complete search history.

(56) References Cited

U.S. PATENT DOCUMENTS

| | | | |
|---|---|---|---|
| 3,523,653 | A | 8/1970 | Hansen |
| 3,627,216 | A | 12/1971 | Ekuan |
| 3,923,223 | A | 12/1975 | Larsson et al. |
| 4,180,160 | A | 12/1979 | Ogawa et al. |
| 4,262,816 | A | 4/1981 | Margulies |
| 4,289,262 | A | 9/1981 | Finkelstein |
| 4,460,106 | A | 7/1984 | Moulding, Jr. et al. |
| 4,524,895 | A | 6/1985 | Lunden |
| 4,534,491 | A | 8/1985 | Norton et al. |
| 4,579,266 | A | 4/1986 | Bünger et al. |
| D285,995 | S | 10/1986 | Minost |
| D296,765 | S | 7/1988 | Urion |
| 4,756,460 | A | 7/1988 | Ornros |
| 4,760,970 | A | 8/1988 | Larsson et al. |
| 4,846,415 | A | 7/1989 | Jernberg et al. |
| 4,864,415 | A | 9/1989 | Beikirch et al. |
| 4,905,868 | A | 3/1990 | Beane et al. |
| 4,979,617 | A | 12/1990 | Benoit |
| 5,065,924 | A | 11/1991 | Granger |
| 5,131,561 | A | 7/1992 | Casperson et al. |
| 5,141,171 | A | 8/1992 | Yang |
| 5,205,455 | A | 4/1993 | Moody |
| 5,211,308 | A | 5/1993 | Decker et al. |
| 5,215,211 | A | 6/1993 | Eberle |

(Continued)

FOREIGN PATENT DOCUMENTS

| | | |
|---|---|---|
| DE | 2222357 | 5/1972 |

(Continued)

OTHER PUBLICATIONS

ASTM Designation: D 3776-96, "Standard Test Methods for Mass Per Unit Area (Weight) of Fabric," pp. 86-89, published Jun. 1996.

(Continued)

*Primary Examiner*—William A. Rivera
(74) *Attorney, Agent, or Firm*—Sue C. Watson

(57) ABSTRACT

A dispenser adapted to dispense sheet material is provided and includes a housing including a platform configured to support a sheet material thereon. The platform includes a slot, and an adjustable orifice configured to alter a size of the slot is provided as well. The housing is formed to include an exit port which is spaced-apart from the platform. When sheet material is disposed in the dispenser, it flows on a generally serpentine path from the platform and through the exit port.

33 Claims, 8 Drawing Sheets

U.S. PATENT DOCUMENTS

| | | | |
|---|---|---|---|
| 5,219,126 | A | 6/1993 | Schutz |
| D337,464 | S | 7/1993 | Giugiaro |
| D339,014 | S | 9/1993 | Giugiaro |
| D339,015 | S | 9/1993 | Giugiaro |
| 5,246,137 | A | 9/1993 | Schutz et al. |
| 5,263,607 | A | 11/1993 | Temesvary et al. |
| 5,273,184 | A | 12/1993 | Rizzuto |
| 5,310,083 | A | 5/1994 | Rizzuto |
| 5,346,064 | A | 9/1994 | Rizzuto |
| 5,370,338 | A | 12/1994 | Lewis |
| 5,480,060 | A | 1/1996 | Blythe |
| 5,560,514 | A | 10/1996 | Frazier |
| 5,577,634 | A | 11/1996 | Morand |
| 5,577,635 | A | 11/1996 | Block |
| 5,582,362 | A | 12/1996 | Johnson et al. |
| D385,734 | S | 11/1997 | Mervar et al. |
| 5,715,971 | A | 2/1998 | Morand |
| 5,715,972 | A | 2/1998 | Siddiqui |
| 5,749,492 | A | 5/1998 | Petterson |
| 5,762,286 | A | 6/1998 | Schutz |
| 5,762,287 | A | 6/1998 | Schutz |
| 5,765,718 | A | 6/1998 | Grasso et al. |
| 5,769,354 | A | 6/1998 | Lindh et al. |
| D396,369 | S | 7/1998 | Giugiaro |
| 5,785,274 | A | 7/1998 | Johnson |
| D403,543 | S | 1/1999 | Grasso et al. |
| 5,857,642 | A | 1/1999 | Zinnbauer |
| 5,868,346 | A | 2/1999 | Cobos |
| 6,062,422 | A | 5/2000 | Ellis |
| 6,082,663 | A | 7/2000 | Tramontina et al. |
| 6,089,499 | A | 7/2000 | Robinson |
| 6,129,240 | A | 10/2000 | Morand |
| 6,145,782 | A | 11/2000 | King et al. |
| 6,182,858 | B1 | 2/2001 | Hartog |
| 6,189,726 | B1 | 2/2001 | Fick |
| 6,267,321 | B1 | 7/2001 | Tramontina |
| D449,474 | S | 10/2001 | Conran et al. |
| 6,328,252 | B1 | 12/2001 | Neveu et al. |
| 6,354,426 | B1 | 3/2002 | Habisreitinger et al. |
| 6,575,397 | B1 | 6/2003 | Tramontina et al. |
| 6,629,667 | B1 | 10/2003 | Tramontina |

FOREIGN PATENT DOCUMENTS

| | | |
|---|---|---|
| DE | 2818757 | 11/1979 |
| EP | 0107487 | 5/1984 |
| EP | 0117567 | 9/1984 |
| EP | 0128127 | 12/1984 |
| EP | 0091411 | 12/1985 |
| EP | 0061248 | 11/1986 |
| EP | 0068722 | 4/1988 |
| EP | 0238460 | 8/1990 |
| EP | 0231183 | 1/1991 |
| EP | 0550863 | 7/1993 |
| EP | 0480848 | 1/1994 |
| EP | 0740921 | 11/1996 |
| EP | 0642317 | 2/1997 |
| EP | 0836825 | 4/1998 |
| EP | 0595779 | 4/2000 |
| EP | 1066787 | 1/2001 |
| FR | 2667853 | 4/1992 |
| FR | 2667854 | 4/1992 |
| FR | 2668694 | 5/1992 |
| FR | 2669818 | 6/1992 |
| GB | 1455216 | 11/1976 |
| GB | 2038778 | 7/1980 |
| GB | 2063213 | 6/1981 |
| GB | 2120639 | 12/1983 |
| GB | 2145693 | 9/1986 |
| GB | 2270299 | 3/1994 |
| WO | WO 93/22963 | 11/1993 |
| WO | WO 93/22964 | 11/1993 |
| WO | WO 97/21377 | 6/1997 |

OTHER PUBLICATIONS

ASTM Designation: D 5035-95, "Standard Test Method For Breaking Force and Elongation of Textile Fabrics (Strip Method)," pp. 682-688, published Jul. 1995.

TAPPI Official Test Method T 411 om-89, "Thickness (Caliper) of Paper, Paperboard, and Combined Board," published by the TAPPI Press, Atlanta, Georgia, revised 1989, pp. 1-3.

DISPENSER FOR SHEET MATERIAL

BACKGROUND OF THE INVENTION

Dispensers for rolls or stacks of sheet material have an exit port which usually permits one sheet material at a time to be dispensed therethrough. Many dispensers which dispense sheet materials are sufficiently complicated to load and re-load that excessive or inadequate dispensing of sheet materials occurs.

In addition, even when a dispenser is operating properly, it can be difficult for an operator to thread newly loaded sheet material through a small or difficult to access opening in a dispensing port. Therefore, reloading provides difficulties for an operator each time new sheet material is disposed in the dispenser.

Problems are also caused in many dispensers when different products are used. That is, sheet material products from the same of other manufacturers often have their own characteristics. The caliper and/or the basis weight of the sheet material of each product will likely be different. Further, the machine direction tensile of the sheet material will vary in different products. Moreover, the tab strength of each sheet material will also vary product-to-product. These differing characteristics of each product type often result in excessive or inadequate dispensing of sheet materials as well.

It would be advantageous to have a dispenser for sheet material which is rolled, or sheet material which is stacked, which permits an operator to quickly and easily load and thread different product types of sheet material using, for example, one hand, and which is easy to adjust for different product types.

DEFINITIONS

As used herein, the term "caliper" refers to the thickness measurement of a sheet taken under constant force. The caliper may be determined using test method number TAPPI 411-OM-89.

As used herein, the term "basis weight" (hereinafter "BW") is the weight per unit area of a sample and may be reported as gram-force per meter squared and may be hereinafter calculated using test procedure ASTM D3776-96.

As used herein, the term "machine direction" (hereinafter "MD") is the direction of a material parallel to its forward direction during processing.

As used herein, the term "machine direction tensile" (hereinafter MDT) is the breaking force in the machine direction required to rupture a specimen. The results may be reported as gram-force and abbreviated as "gf". The MDT may be determined using test method number ASTM D5035-95.

As used herein, the term "tab strength" is the breaking force in the machine direction required to rupture a sheet product along its perforations. The results may be reported as gram-force and abbreviated as "gf".

As used herein, the term "exit port" or "dispensing port" is the opening in a housing of a dispenser for the passage of sheet material out of the dispenser.

As used herein, the term "centerflow roll" or "centerflow roll product" means sheet material wound cylindrically about a center, but permitting the removal of material from the center. Desirably, as the centerflow roll is consumed, sheet material dispenses from the roll's inner periphery. Dispensing of centerflow roll products are described in numerous patents, such as, but not by way of limitation, U.S. Pat. No. 5,370,338 to Lewis and U.S. Pat. No. 6,082,663 to Tramontina et al.

As used herein, the term "sheet material" means a material that is thin in comparison to its length and breadth. Generally speaking, sheet materials should exhibit a relatively flat planar configuration and be flexible to permit folding, rolling, stacking, and the like. Exemplary sheet materials include, but are not limited to, paper tissue, paper towels, label rolls, or other fibrous, film, polymers, or filamentary products.

As used herein, the term "fasteners" means devices that fasten, join, connect, secure, hold, or clamp components together. Fasteners include, but are not limited to, screws, nuts and bolts, rivets, snap-fits, tacks, nails, loop fasteners, and interlocking male/female connectors, such as fishhook connectors, a fish hook connector includes a male portion with a protrusion on its circumference. Inserting the male portion into the female portion substantially permanently locks the two portions together.

As used herein, the term "hinge" refers to a jointed or flexible device that connects and permits pivoting or turning of a part to a stationary component. Hinges include, but are not limited to, metal pivotable connectors, such as those used to fasten a door to frame, and living hinges. Living hinges may be constructed from plastic and formed integrally between two members. A living hinge permits pivotable movement of one member in relation to another connected member.

As user herein, the term "couple" includes, but is not limited to, joining, connecting, fastening, linking, or associating two things integrally or interstitially together.

SUMMARY OF THE INVENTION

In one aspect of the invention, A dispenser adapted to dispense sheet material therefrom is provided and includes a housing including a platform configured to support sheet material thereon. The platform includes a slot, and an adjustable orifice configured to alter the size of the slot is provided as well. The housing is formed to include an exit port which is spaced-apart from the platform. When sheet material is disposed in the dispenser, it flows on a generally serpentine path from the platform and through the exit port.

DETAILED DESCRIPTION

Figure 1:
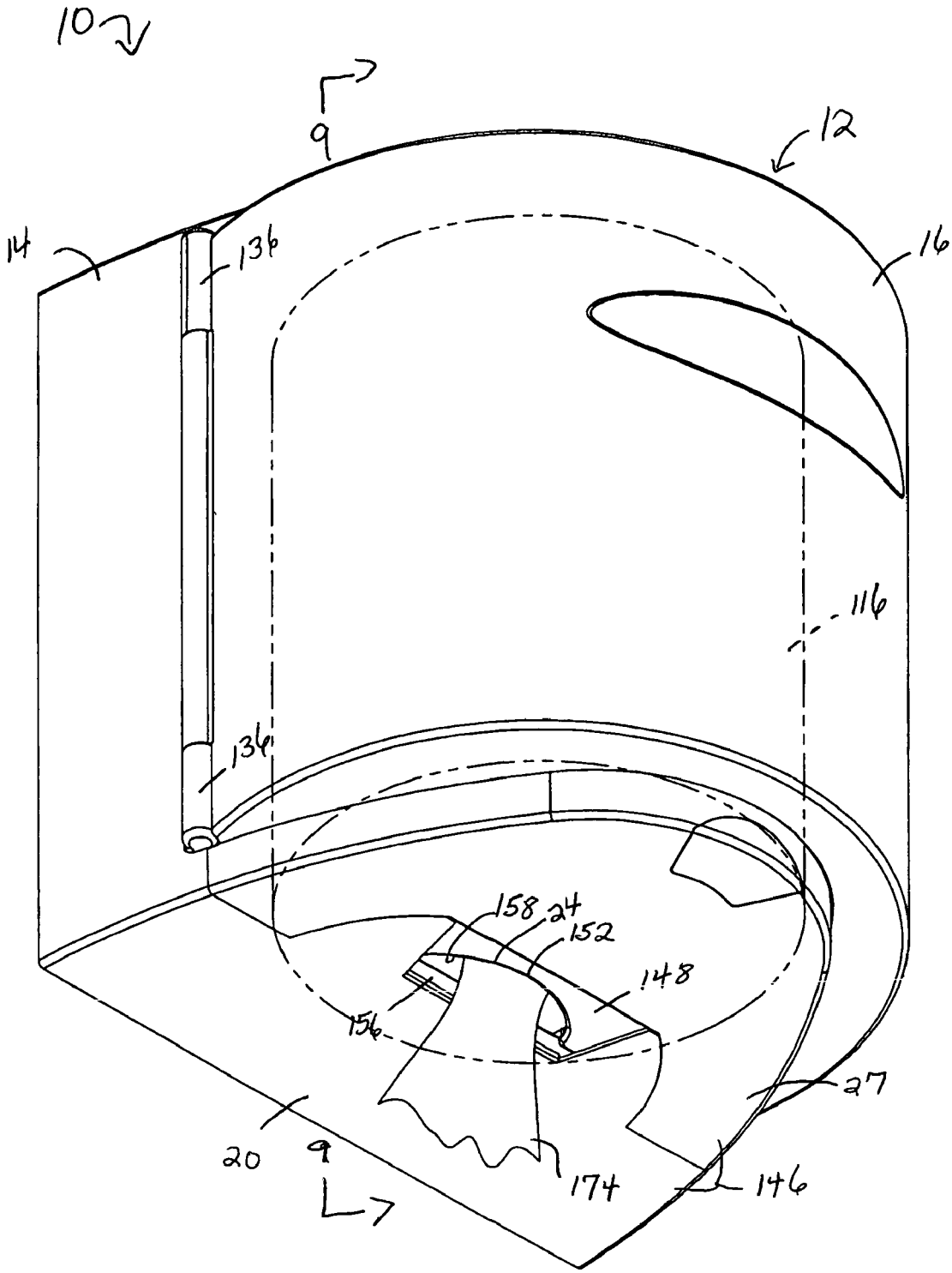
FIG. 1 is a perspective view of a dispenser for dispensing sheet material from the lower end of the dispenser, showing a roll of centerflow sheet material disposed in the dispenser (illustrated by phantom lines) and sheet material extending from an exit port.

Reference will now be made in detail to the presently preferred embodiments of the invention, one or more examples of which are illustrated in the drawings. Each example is provided by way of explanation of the invention and is not meant as a limitation of the invention. For example, features illustrated or described as part of one embodiment or figure can be used on another embodiment or figure to yield yet another embodiment. It is intended that the present invention include such modifications and variations.

Figure 2:
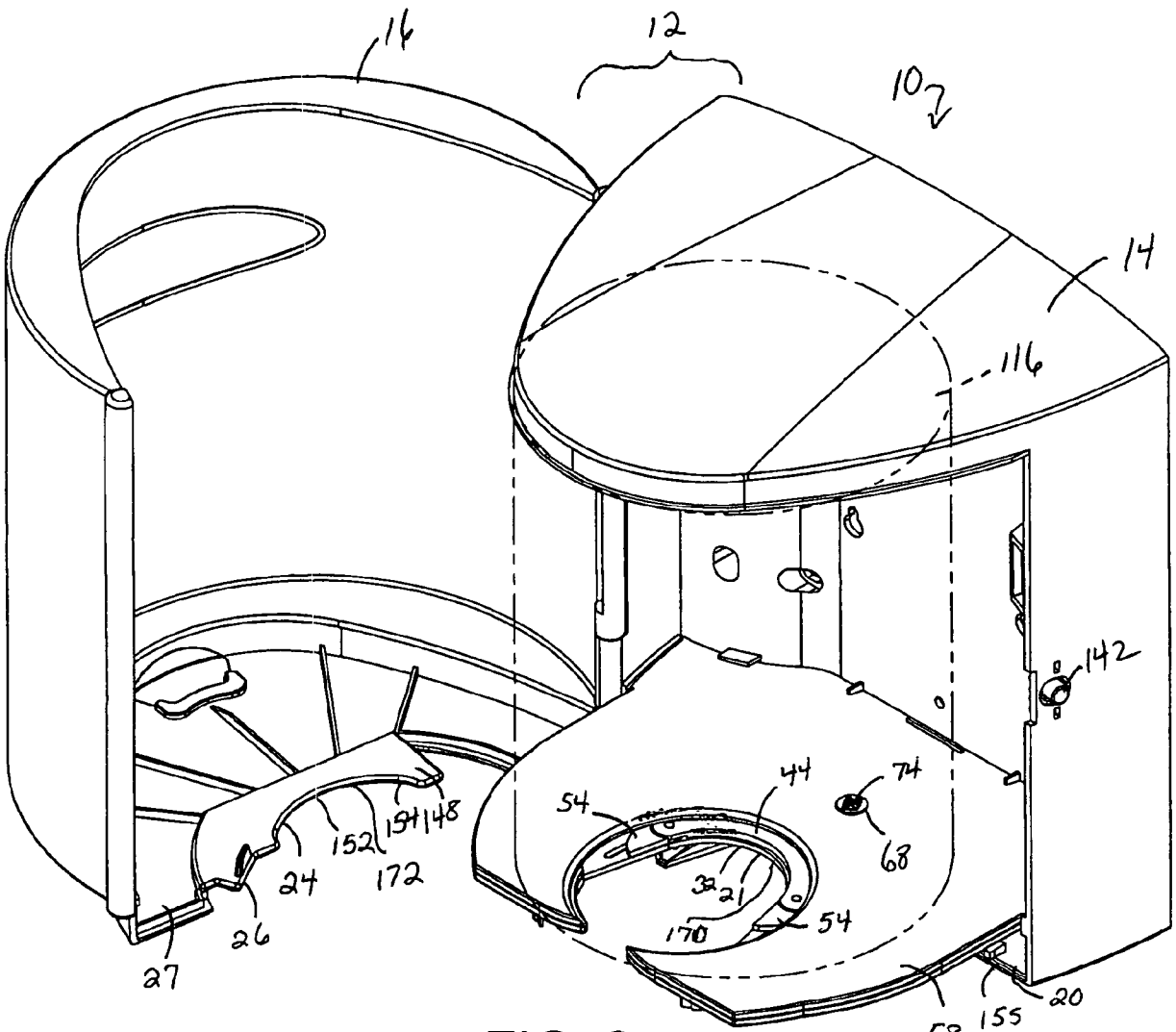
FIG. 2 is a perspective view of the dispenser of FIG. 1, showing the dispenser opened and a roll of centerflow sheet material (illustrated by phantom lines) disposed therein.
Figure 3:
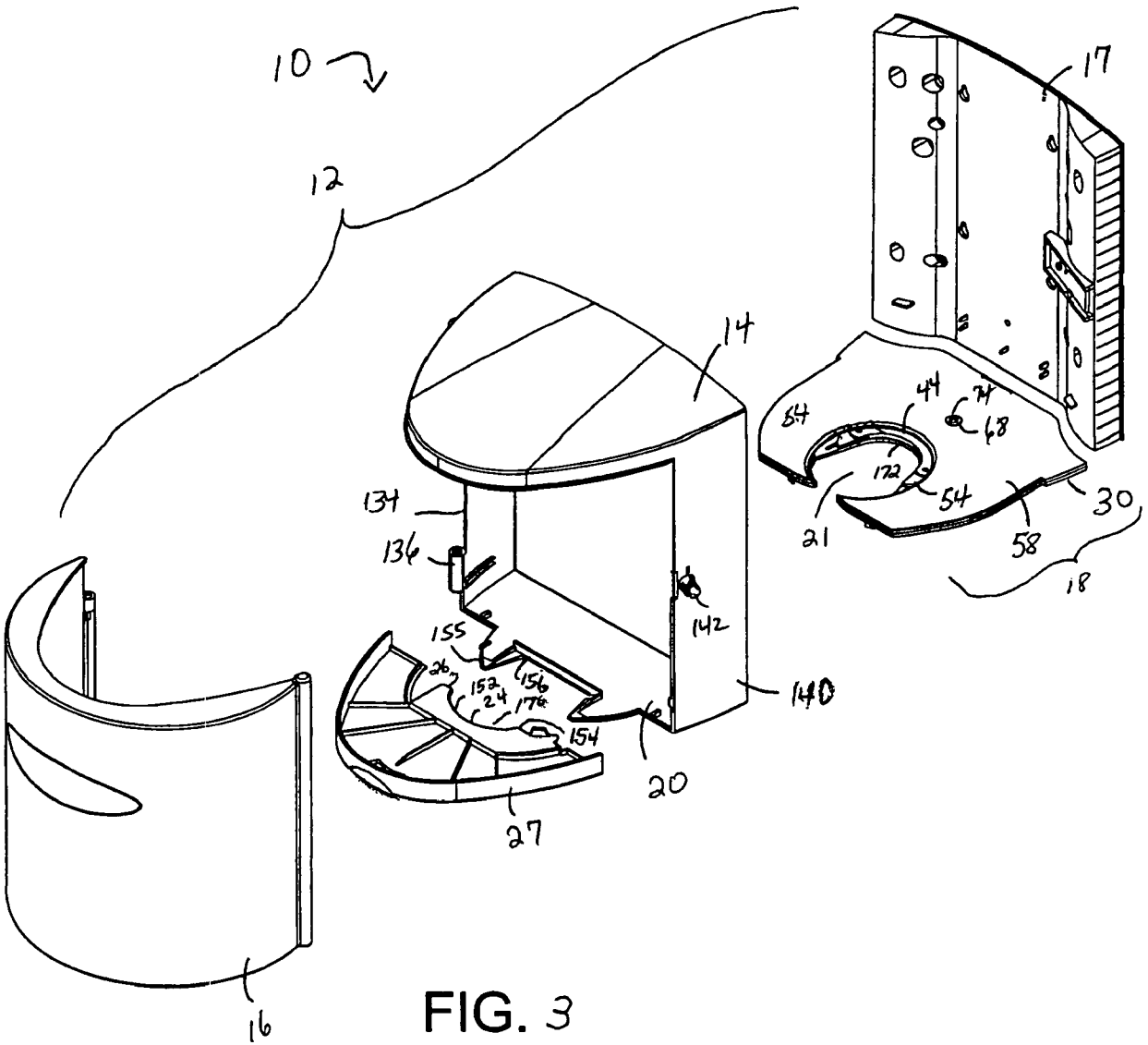
FIG. 3 is an exploded view of the dispenser of FIG. 2.

Illustrated in FIGS. 1–9 is a dispenser 10 for sheet material. The dispenser 10 includes a dispenser housing 12, as shown in FIGS. 1–3. The dispenser housing 12 includes a roll housing 14 and a cover 16.

Figure 4:
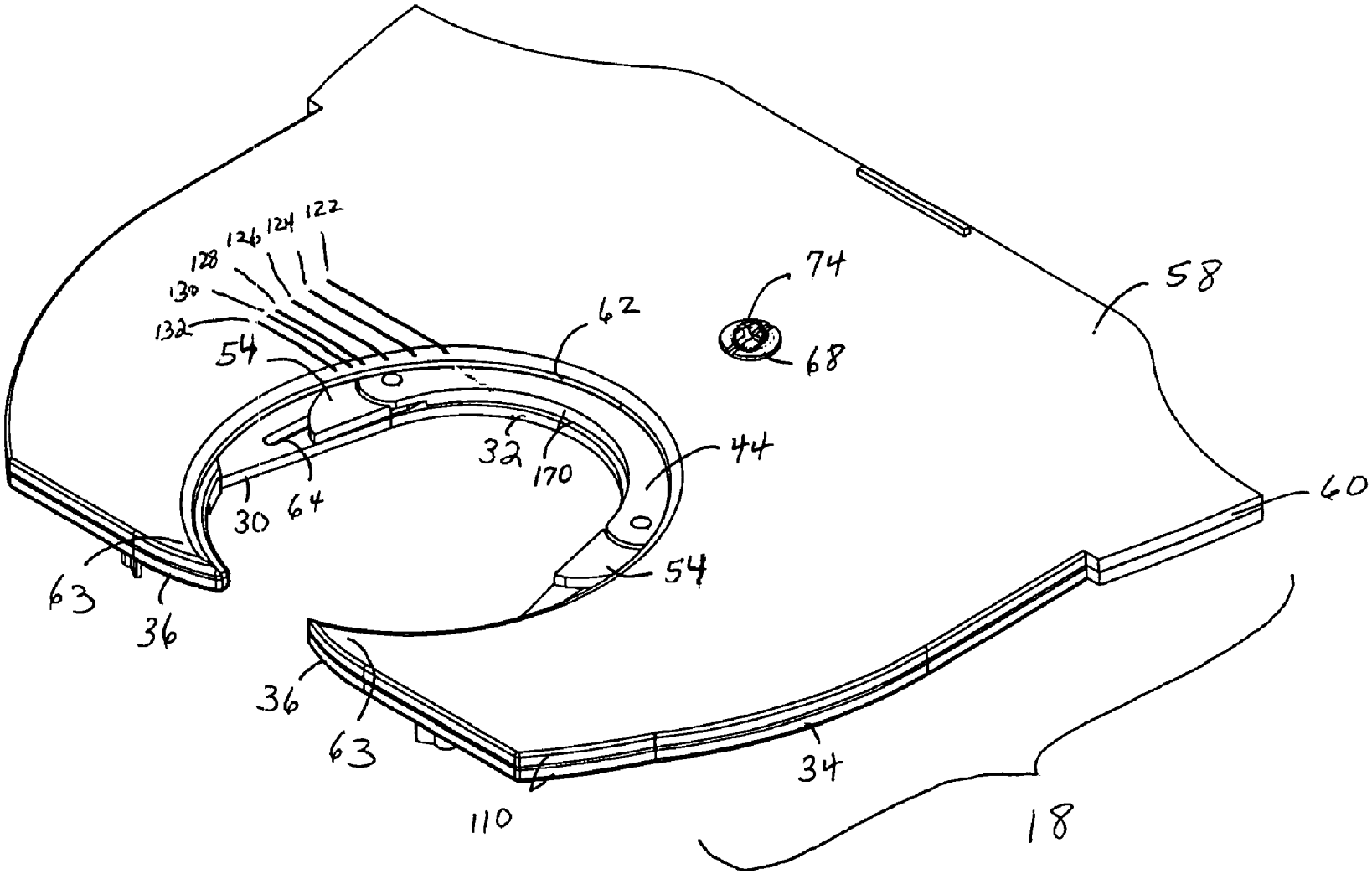
FIG. 4 is a perspective view of a support platform of the present invention, showing the slot therein and an adjustable orifice.
Figure 5:
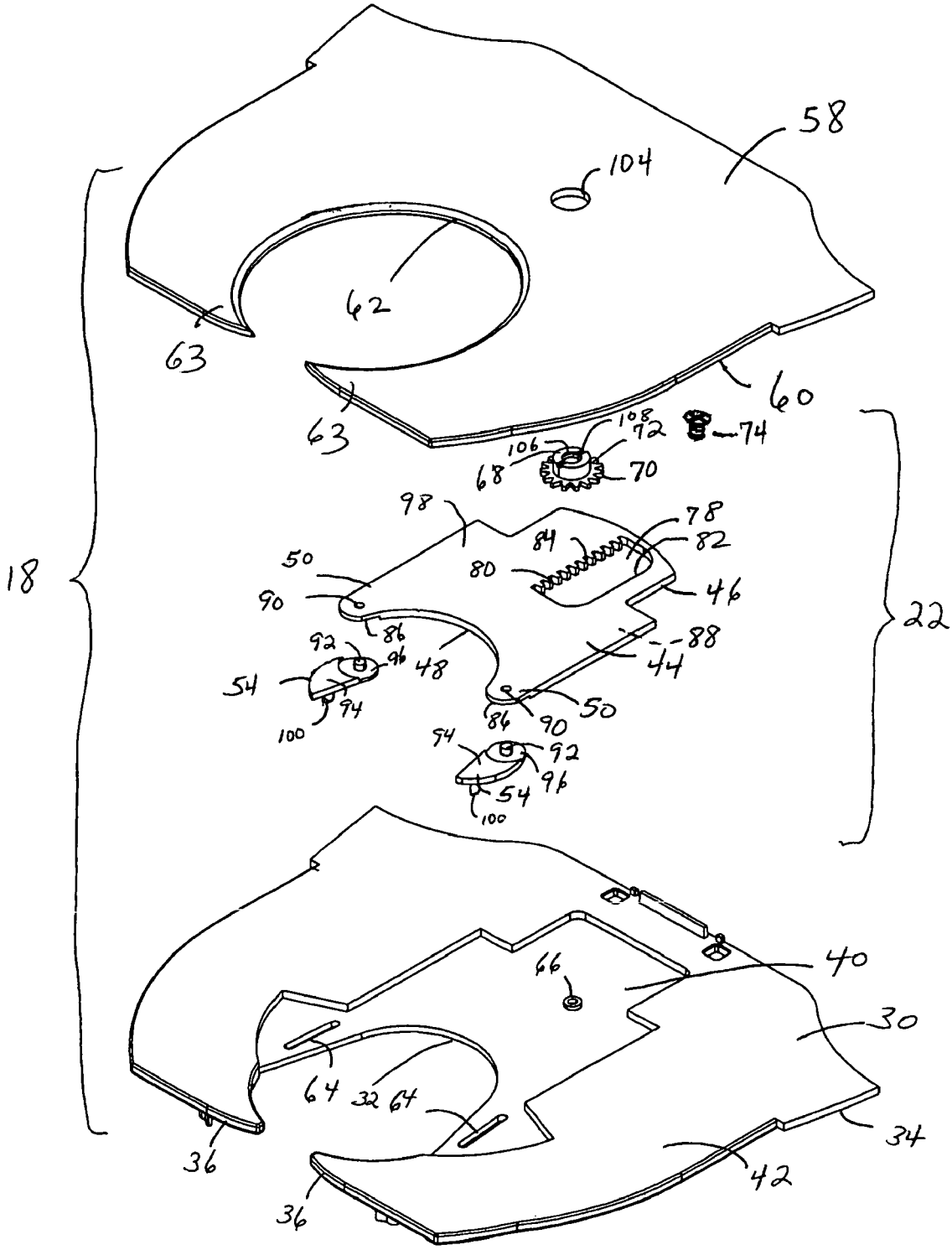
FIG. 5 is an exploded view of the support platform shown in FIG. 4, showing the components of the support platform and the adjustable orifice.

The roll housing 14 desirably includes a back plate 17 which is configured to permit attachment of the dispenser 10 to a wall or suitable surface (not shown). The roll housing 14 also includes a roll platform or support platform 18 which is positioned near a lower end 20 of the roll housing 14. As illustrated in FIG. 4, the support platform 18 includes a slot 21 around which is provided an adjustable orifice 22. An adjustment means includes at least the adjustable orifice 22 on and/or positioned adjacent at least a portion of the support platform 18.

Another slot or a second lower orifice 24 is positioned on a front edge 26 of a lower end portion 27 of the cover 16. The support platform 18 and the adjustable orifice 22 associated therewith are spaced a distance 28 apart (FIG. 9) from the lower end 20 of the roll housing 14 to permit a sheet to flow therethrough. The second lower orifice 24 and its interaction with the slot 21 and the adjustable orifice 22 will be discussed in further detail below Turning now to the support platform 18 and the adjustable orifice 22, as illustrated in FIGS. 4–7, the support platform 18 desirably includes a base plate 30 having a curved slot 32 formed in an outer perimeter 34 thereof. The curved slot 32 is flanked by opposing arms 36 on each side thereof. A recessed portion 40 is formed in a central area of an upper surface 42 of the base plate 30 adjacent the curved slot 32. The recessed portion 40 is configured to permit a slide 44 to be movably positioned therein, and to extend beyond the outer perimeter 34 adjacent the curved slot 32. The slide 44 includes an outer perimeter 46 and it has a curved area 48 as well, which generally corresponds to the shape of the curved slot 32. The slide 44 includes a pair of spaced-apart arms 50, one arm 50 positioned on each side of the curved area 48. Each arm 50 desirably includes an opposing movable pivot arm 54 which is pivotably coupled thereto. A top plate 58 is also desirably provided. The top plate 58, similar to the slide 44 and the base plate 30, also has an outer perimeter 60 having a curved portion 62, and opposing arms 63 as well. Each of these mechanisms and their additional features and characteristics will be described in greater detail below.

The base plate 30 desirably includes a pair of cam slots 64. One cam slot 64 is formed on each arm 36. The base plate 30 also may include, desirably in the recessed portion 40, a boss member 66. A pinion gear 68 is desirably movably coupled to the boss member 66, to permit rotation of the pinion gear 68. To this end, the pinion gear 68 has teeth 70 extending outward from an outer perimeter thereof 72. The pinion gear 68 may freely rotate until a threaded locking screw 74 is positioned in a threaded portion (not shown) of the pinion gear 68 and tightened. This action prevents the pinion gear 68 as well as the associated slide 44 from moving.

The slide 44 includes an opening 78 therein. Teeth 80 are formed along a portion of a perimeter 82 of the opening 78, and provide a gear rack 84. In operation, the slide 44 is positioned in the recessed portion 40 of the base plate 30 and the opening 78 is positioned over the pinion gear 68. The teeth 80 of the gear rack 84 mesh and cooperate with the teeth 70 of the pinion gear 68 to provide movement of the slide 44 when the pinion gear 68 is rotated.

Two recessed notches 86 are desirably formed on a lower surface 88 of the slide 44 and permit the pivotable coupling of the movable pivot arms 54 thereto. The slide 44 may also includes pivot holes 90 which accept pivot pins 92. The pivot pins 92 are desirably provided on an upper surface 94 of each pivot arm 54 in a recessed area 96 formed in each of the pivot arms 54. The pivot pins 92 cooperate to pivotably couple the pivot arms 54 to the slide 44 such that the recessed area 96 of the upper surface 94 of each pivot arm 54 is positioned against a recessed notch 86 on the lower surface 88 of the slide 44. When the pivot arms 54 are coupled to the slide 44, both mechanisms cooperate to desirably provide a generally planar surface combining an upper surface 98 of the slide 44 and the upper surface 42 of the base plate 30. Similarly, the lower surface 88 of the slide 44 may also provide a generally a planar surface, even though a cam pin 100 which extends downward from a lower surface (not shown) of each pivot arm 54.

Figure 6:
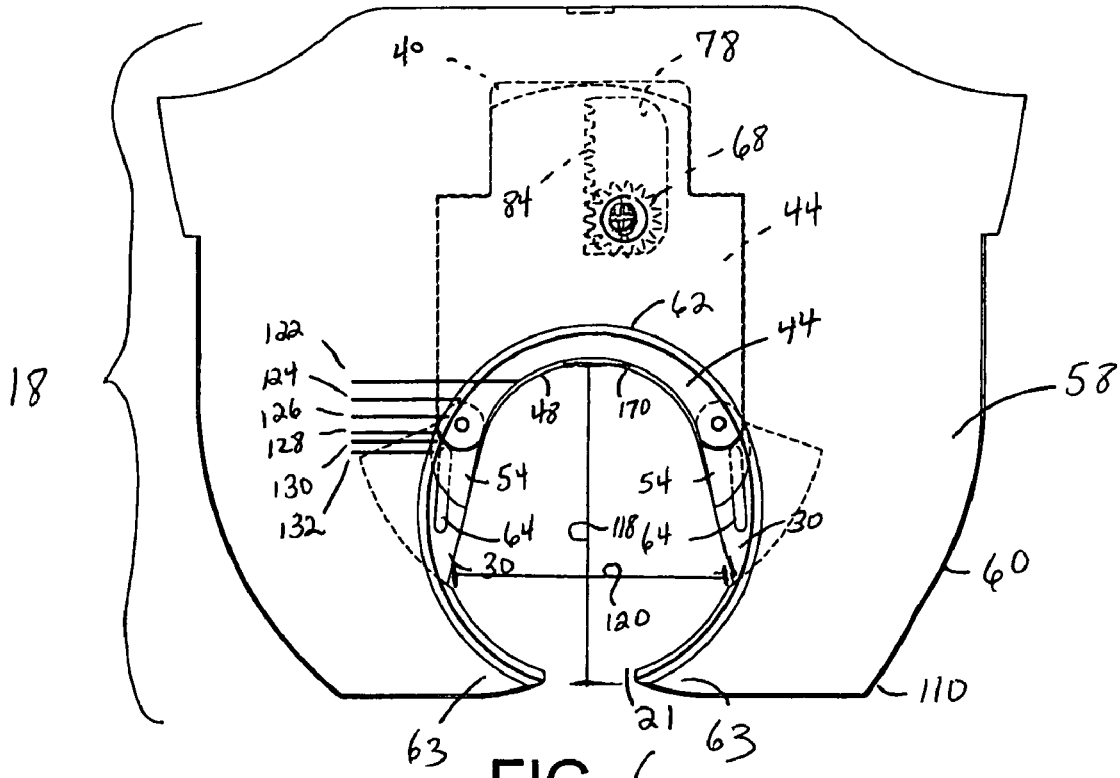
FIG. 6 is a top plan view of the support platform of FIG. 4, showing the adjustable orifice adjusted to provide the greatest depth and therefore the largest opening of the slot in the support platform.
Figure 7:
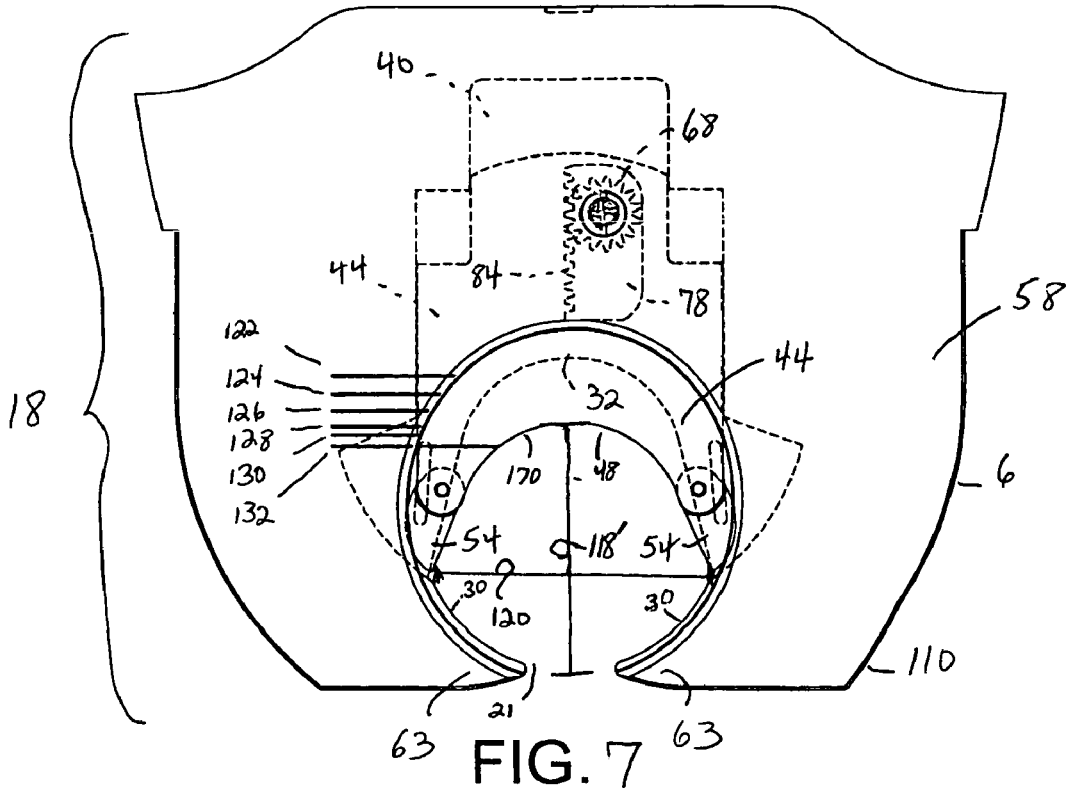
FIG. 7 is a top plan view of the support platform of FIG. 4, showing the adjustable orifice adjusted to provide the least depth and therefore the smallest opening of the slot in the support platform.

Each cam pin 100 is desirably positioned in a cam slot 64 in the base plate 30. In operation, the cam pins 100 and the cam slots 64 cooperate with the slide 44 to permit pivotable movement of each pivot arm 54 about the slot 32 of the base plate 30 when the slide 44 is moved via the pinion gear 68. That is, when the slide 44 is moved axially within the recessed portion 40 of the base plate 30, the pivot arms 54 move to cooperate with the slide 44 to make the slot 21 larger or smaller, as shown in FIGS. 6 and 7. When the curved area 48 of the slide 44 is moved toward the back plate 17 of the roll housing 14 to enlarge the slot 21, the pivot arms 54 pivot or move toward the slot 21, cooperating with the slide 44 to define the greater depth of the slot 21. Conversely, when the curved area 48 of the slide 44 is moved away from the back plate 17 to reduce the size of the slot 21, the pivot arms 54 pivot or move outward, away from the slot 21 to define the smaller configuration of the slot 21. The slide 44 with the pivot arms 54 cooperate to provide a U-shaped configuration to at least a portion of the slot 21, whether the slot 21 is adjusted to be larger or smaller.

The top plate 58 is desirably positioned over and against the upper surface 42 of the base plate 58 and the upper surface 98 of the slide 44. The features of the top plate 58, namely, the outer perimeter 60, the curved area 48 and the opposing arms 63 are positioned generally over and in alignment with the same features of the base plate 30 (i.e., the outer perimeter 34, the curved slot 32 and the opposing arms 36). The top plate 58 includes an aperture 104 sized to permit the pinion gear 68 to be accessed, and to permit the locking screw 74 to be positioned therethrough to couple to the pinion gear 68.

The adjustment slot 108 in the pinion gear 68 permits an instrument, such as an end of a screw driver (not shown), and so forth to be inserted into the slot 108 to cause rotation of the pinion gear 68. Such rotation moves the slide 44 axially inward toward the backplate 17 or outward away from the back plate 17 in the recessed portion 40 of the base plate 30, to enlarge or reduce the size of the slot 21. Simultaneously, the pivot arms 54 coupled to the slide 44 are pivotably moved inward to define a greater depth of the slot 21 when the slide 44 is moved toward the back plate 17 to enlarge the slot 21, or outward to define a reduced depth of the slot when the slide moves away from the back plate 17 to decrease the size of the slot. The movement of the pivot arms 54 is controlled by the connection of the cam pins 100 in the cam slots 64 of the base plate 30. Once the slide 44 has been positioned, the threaded locking screw 74 may be positioned or screwed into a top portion 106 of the pinion gear 68. The top portion 106 is configured to receive the locking screw 74 to permit the size of the slot 21 to be set and to prevent unwanted rotation of the pinion gear 68 which would change the slot 21 size. Alternatively, a knob may be formed in the top portion of the pinion gear (not shown), and so forth.

One configuration for a support platform 18 and adjustable orifice 22 includes the mechanisms previously described herein. For example, however, but not by way of limitation, a platform which includes an opening may be provided, and an adjustable orifice may be positioned above the support platform, or, alternatively, below the support platform. It will be understood, however, that the support platform 18 and/or the adjustable orifice 22 may comprise any greater or lesser number of mechanisms and/or configuration(s), so long as the support platform 18 and/or the adjustable orifice 22 to operate as shown and/or described herein.

The slot 21 provided in the support platform 18 is generally a circular opening through the support platform 18. The slot 21 is formed at one end of the support platform 18 and extends through an outer perimeter edge 110 of the support platform 18, which forms the separate and opposing arms 36 in the support platform 18. Each arm 36 forms a separate and opposing acute angle relative to the other.

Figure 8:
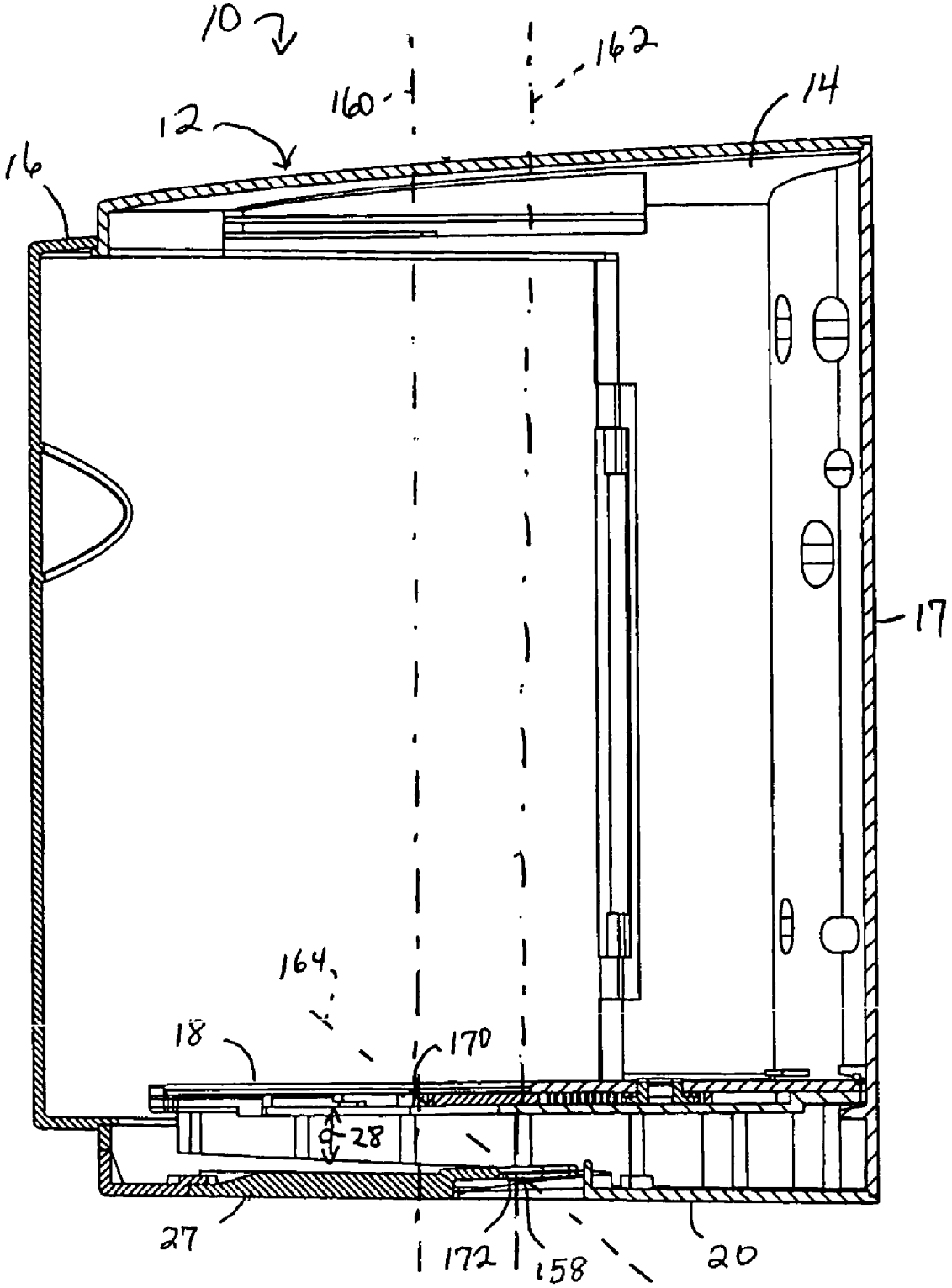
FIG. 8 is a sectional view of the dispenser in a closed position, showing the position of the slot of the support platform and the slot of the second lower orifice forming a portion of the exit port as well as the distance between the slot in the platform and the exit port.

The slot 21 and the adjustable orifice 22 provided thereabout provide an exit in the support platform 18 through which sheet material 114 from a center flow roll 116 positioned on the support platform 18 may flow. In the present embodiment, the slot 21 provided in the support platform is generally C-shaped. The adjustable orifice 22 provides a concave and curved form therein, providing a generally parabolic or widened U-shape, as illustrated in FIGS. 2–7. Both the shape of the slot 21 and the shape of the adjustable orifice 22 are non-limiting; other configuration(s) may be used. The adjustable orifice 22 permits adjustment of the size of the slot 21 to provide a larger opening or exit, or a smaller opening or exit. A depth 118, and to a lesser degree, a width 120 of the slot 21 and the adjustable orifice 22 are dictated by the product-type of sheet material 114 positioned in the dispenser 10. For example, in the present embodiment the adjustable orifice 22 is capable of being positioned in at least six (6) positions, namely a first position 122, a second position 124, a third position 126, a fourth position 128, a fifth position 130, and a sixth position 132. As shown in FIG. 6, the adjustable orifice 22 is positioned in a first position 122 which provides the greatest depth 118 to the slot 21. The greatest depth 118 of the slot 21 causes less frictional resistance, and is commonly used with thicker, such as, but not by way of limitation, increased caliper and/or greater basis weight sheet material product, to permit the sheet material 114 to flow properly through the dispenser 10, without tearing off inside of the dispenser 10, thereby frustrating a user. Thinner, namely, decreased caliper and/or lower basis weight sheet material products, often require much less depth of the slot 21. Therefore, for such a thin sheet material product, the adjustable orifice 22 would be positioned, for example, in a sixth position 132, as illustrated in FIG. 7, which provides the least depth 118' to the slot 21. Greater frictional resistance is required of the thinner, i.e., lower caliper and/or lower basis weight sheet material product, to prevent excess sheet material 114 from flowing through the dispenser 10, causing waste. In between the first position 122 (greatest depth) and the sixth position 132 (least depth), as illustrated in FIGS. 7 and 8, a number of other positions are possible to adjust the size of the opening defined by the slot 21. While six adjustment positions are illustrated, this is intended as a non-limiting example, and any number of adjustment positions are possible. The various adjustment positions are provided to accommodate sheet material products having various characteristics, such as, for example, various machine direction tensile strength, tab strength, basis weights, calipers, and so forth. The adjustable orifice 22 is provided to assure that the sheet material products disposed in the dispenser 10 are dispensed in appropriate amounts which adequately satisfy a user but which reduce waste.

Turning back to the dispenser housing 12, the cover 16, as illustrated in FIGS. 1–3, is coupled to one side wall 134 of the roll housing 14 via a hinge 136 that is secured to both a portion of the side wall 134 and a portion of the cover 16. The hinge 136 permits the cover 16 to pivot away from the roll housing 14, to permit generally frontal access to the roll housing 14 and the support platform 18. A hinge is not intended as a limiting feature of the invention; fasteners and/or other mechanisms known in the art may be used instead.

Fasteners (not shown) are desirably positioned on an opposite side 140 of the roll housing 14 and the cover 16, respectively, along with a push button/latch release 142, to secure the cover 16 in a closed position, for illustrative purposes. It will be appreciated that a tamper-proof fastener or locking mechanism (not shown) may be used to permit only an operator access to the centerflow roll 116 of sheet material 114 contained in the dispenser 10. The cover 16, the roll housing 14 or any portions of either may be formed from an opaque material, or alternatively, the cover 16, or any portion thereof, may be formed from a clear, tinted, or translucent material, so that a reduction in the centerflow roll 116 disposed in the dispenser 10 can be seen by an operator. The cover 16 is desirably rounded, to at least partially follow the curvature of the centerflow roll 116 of sheet material 114 positioned therein, although numerous other shapes may be used. The dispenser housing 12, or any portion thereof, is a non-limiting feature of the invention and may take any shape or configuration, in accordance with any desired functional and/or aesthetic attributes. In addition, the dispenser housing 12 may be made of any sutable material.

The cover 16 has a lower end portion 27 which, together with the lower end 20 of the roll housing 14, cooperates to provide a lower end 146 of the dispenser housing 12. The lower end portion 27 includes the second lower orifice 24.

The second lower orifice 24 in the present embodiment is generally provided in a plate 148 having at one end thereof a concave curved slot 152 which provides a portion of a perimeter 154 of the plate 148. The plate 148 is intended as a non-limiting feature; the lower orifice 24 may, alternatively, be formed in a portion of the roll housing 14 (not shown). The concave curved slot 152 forms a semi-elliptical shape, although numerous other shapes or configurations may be used as well. Similarly, the configuration of the plate 148 is not a limiting feature of the invention and the plate 148 may take any shape or configuration.

Figure 9:
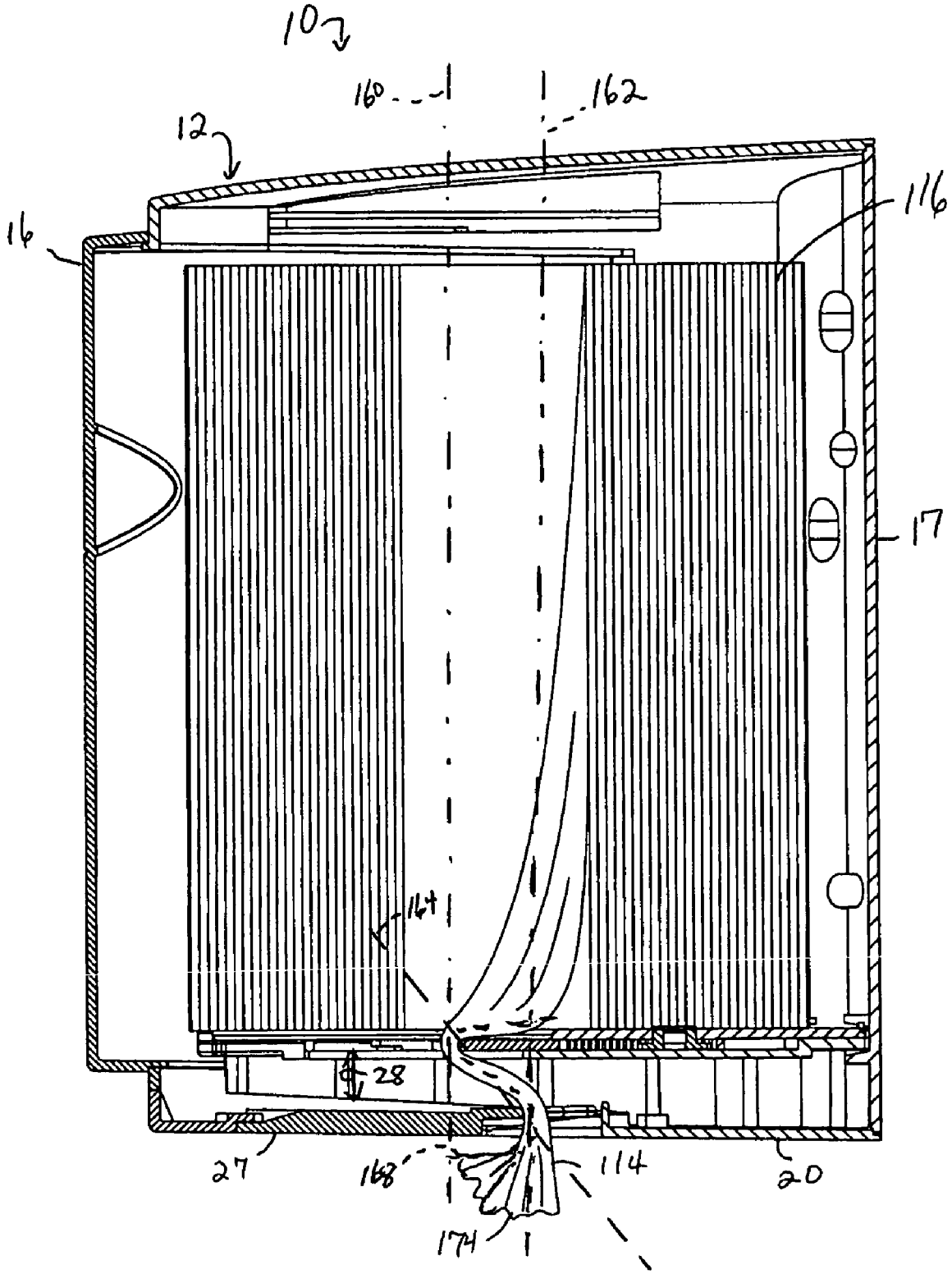
FIG. 9 is a sectional view similar to FIG. 8 but taken along lines 9—9, showing a centerflow roll positioned in the dispenser and the path of the sheet material as it flows from the support platform through the exit port.

When the lower end 20 of the roll housing 14 and the lower end portion 27 of the cover 16 are brought together to provide a closed dispensing position of the dispenser 10, as illustrated in FIGS. 1, 8 and 9, a perimeter 154 adjacent the plate 148 (having the second lower orifice 24) and the front edge 26 on the lower end portion 27 of the cover 16 moves into a cooperative position adjacent a perimeter edge 155 having a straight edge 156 formed in at least a portion thereof positioned on the lower end 20 of the roll housing 14. The straight edge 156 cooperates with the second lower orifice 24 to provide an exit port 158 in the dispenser housing 12. The front edge 26 of the cover 16 and the perimeter edge 155 of the roll housing 14 cooperate to provide a closed dispensing position of the dispenser 10 (FIGS. 1, 8 and 9). In this instance, the exit port 158 includes one semi-elliptical side provided by the second lower orifice 24 on the cover 16 and one straight edge 156 provided by the lower end 20 of the roll housing 14, but numerous other configurations are possible. In use, the sheet material 114 from the centerflow roll 116 positioned on the support platform 18 flows through the slot 21 as modified by the adjustable orifice 22 and past the second lower orifice 24 which forms a portion of the exit port 158, thereby flowing through the exit port 158.

In one alternative, the second lower orifice 24 may be configured to be adjustable via an adjustable orifice as described previously, while the upper slot 21 is fixed (not shown). In another alternative, both the second lower orifice 24 and the upper slot 21 may be adjustable via an adjustable orifice (not shown).

The concave curved slot 152 of the second lower orifice 24 in the plate 148 is positioned generally in front of and facing the concave and curved portion of the slot 21 and adjustable orifice 22, as illustrated in FIGS. 2 and 3, when the dispenser 10 is opened by moving the cover 16 away from the roll housing 14, as shown in FIG. 2. However, the curved slot 152 is positioned behind the slot 21 and the adjustable orifice 22 in the support platform 18 when the dispenser 10 is closed, as illustrated in FIGS. 8 and 9. A first axis 160 extends through the slot 21 and the adjustable orifice 22. A second axis 162 extends through the slot 152 of the second lower orifice 24, and it is desirably spaced-apart and parallel to axis 160. An oblique third axis 164 extends through both the slot 21 and the adjustable orifice 22 provided therewith and the slot 152 of the lower second orifice 24, intersecting both axis 160 and axis 162. In addition, the slot 21 and adjustable orifice 22 on the support platform 18 are separated from the plate 148 providing the second lower orifice 24 and slot 152 by a distance 28 between the support platform 18 and the lower end 20 of the roll housing 14. The sheet material 114 flows between the slot 21 and the exit port 158 on the third axis 164.

As illustrated in FIG. 9, the sheet material 114 follows generally a circuitous, serpentine path, such as an S-shaped path 168 as it flows through the non-aligned slots 21, 24 of the spaced-apart support platform 18 with adjustable orifice 22 and the second lower orifice 24 in the exit port 158 of the dispenser 10. The path 168 which the sheet material 114 follows in exiting the dispenser 10 creates a frictional resistance of the sheet material 114 caused by the configuration of the path 168. Resistance is created when the sheet material 114 moves or flows against the edges 170, 172 of the slots 21 as modified by the adjustable orifice 22 and the slot 152, respectively, of the second lower orifice 24. Frictional resistance is also created by selection of the size and configuration of the slots 21, 152 as well as the modification of slot 21 by the adjustable orifice 22, as described previously. These characteristics, desirably but not by way of limitation, in combination, cooperate to provide dispensing of a proper amount of sheet material, i.e., one sheet material at a time, thereby avoiding excessive dispensing or under dispensing of sheet material.

In a method of installing sheet material 114 in a dispenser, a dispenser 10 having an exit port 158 is provided. An operator opens the dispenser housing 12 by actuating or pushing the push button/latch release 142 thereby releasing the cover 16 from its closed position against the roll housing 14 and moving the cover 16 desirably at least partially away from the roll housing 14 so that the support platform 18 may be accessed, as shown in FIG. 2. The support platform 18 includes the slot 21 and the adjustable orifice 22 provided therewith, in which the depth 118 of the slot 21 and to a lesser extent the width 120 are modified by the adjustable orifice 22. The desired configuration of the slot is selected by an operator via the adjustable orifice 22, based on the sheet material product and the characteristics thereof as described in detail previously herein, in order to dispense an effective number of sheet materials 114 through the slot 21, 152 and the exit port 158. A center flow roll 116 of sheet material 114 is positioned on the support platform 18, and a leading edge 174 of the sheet material 114 is threaded through the slot 21 and is positioned a distance from the lower end of the dispenser housing 12. The dispenser housing 12 is closed by moving the cover 16 into a closed position against the roll housing 14. In doing so, the leading edge 174 of the sheet material 114 is moved against the slot 152 of the second lower orifice 24, and is held in place through the exit port 158 by the abutment of the lower end portion 27 of the cover 16 against the lower end 20 of the roll housing.

The dispenser 10 is configured to permit a user to open the dispenser housing 12, adjust the adjustable orifice 22 in the support platform 18, while using only one hand. In addition, the dispenser 10 is configured to permit a user to dispose a new centerflow roll 116 of sheet material 114 in the dispenser housing 12, thread the leading edge 174 of the sheet material 114 through the slot 21, and close the cover 16 against the roll housing 14 to provide a closure to the dispenser 10, all while using only one hand.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. A dispenser adapted to dispense sheet material, the dispenser comprising:

a housing including a platform configured to support sheet material thereon, the platform including a slot and an adjustable orifice configured to alter a size of the slot, the slot and adjustable orifice positioned on a first axis, the housing formed to include an exit port spaced apart from the platform, the exit port positioned on a second axis;

wherein sheet material disposed in the dispenser flows between the opening in the platform and the exit port on a third axis.

2. The dispenser of claim 1, wherein the platform includes a base plate.

3. The dispenser of claim 2, wherein the base plate is configured to carry a movable slide.

4. The dispenser of claim 3, wherein the movement of the slide alters the size of the slot.

5. The dispenser of claim 3, wherein the slide provides at least a portion of the adjustable orifice.

6. The dispenser of claim 5, wherein the slide includes a pair of spaced-apart pivot arms pivotably coupled thereto.

7. The dispenser of claim 6, wherein the slide and pivot arms move on at least a portion of the base plate.

8. The dispenser of claim 1, wherein the housing includes a roll housing and a cover.

9. The dispenser of claim 8, wherein a portion of the exit port includes an orifice provided by a portion of the cover.

10. The dispenser of claim 8, wherein a portion of the exit port is provided by the roll housing.

11. The dispenser of claim 1, wherein the sheet material follows a generally serpentine path from the opening in the orifice plate and through the exit port.

12. The dispenser of claim 11, wherein the serpentine path causes frictional resistance that assists in dispensing one sheet material at a time from the dispenser.

13. The dispenser of claim 11, wherein the sheet material flows a distance between the support platform and exit port.

14. The dispenser of claim 11, wherein the size of the slot is adjusted via the adjustable orifice in accordance with a selected characteristic of the sheet material.

15. The dispenser of claim 1, wherein the slot in the platform forms a C-shape.

16. The dispenser of claim 15, wherein the adjustable orifice provides a widened U-shape within the slot.

17. A dispenser adapted to dispense sheet material, the dispenser comprising a housing including a platform configured to support sheet material thereon, the platform including a slot and an adjustable orifice configured to alter the size of a slot, the housing formed to include an exit port spaced apart from the support platform, wherein sheet material disposed in the dispenser flows on a generally serpentine path from the platform and through the exit port.

18. The dispenser of claim 17, wherein the platform includes a base plate.

19. The dispenser of claim 18, wherein the base plate is configured to carry a movable slide.

20. The dispenser of claim 19, wherein the slide provides at least a portion of the adjustable orifice.

21. The dispenser of claim 20, wherein the movement of the slide alters the size of the slot.

22. The dispenser of claim 20, wherein the slide includes a pair of spaced-apart pivot arms pivotably coupled thereto.

23. The dispenser of claim 22, wherein the slide and pivot arms move on at least a portion of the base plate.

24. The dispenser of claim 17, wherein the sheet material flows a distance between the support platform and exit port.

25. The dispenser of claim 17, wherein the slot and adjustable orifice are positioned on a first axis, and the exit port is positioned on a second axis.

26. The dispenser of claim 25, wherein the sheet material positioned between the support platform and the exit port is disposed on a third axis.

27. A dispenser adapted to dispense sheet material, the dispenser comprising:

a housing including a platform having a slot therein configured to hold sheet material, the housing having an exit port spaced apart from the platform; and means positioned on the platform for controlling the movement of sheet material disposed in the housing through the exit port, the controlling means including an adjustable orifice, wherein the platform includes a base plate configured to carry a movable slide, and wherein the movable slide provides at least a portion of the adjustable orifice, and wherein the slide includes a pair of spaced-apart pivot arms pivotably coupled thereto, and wherein the slide and pivot arms move on at least a portion of the base plate.

28. The dispenser of claim 27, wherein the movement of the slide alters the size of the slot.

29. The dispenser of claim 27, wherein the slide and the pivot arms provide at least a portion of the adjustable orifice.

30. The dispenser of claim 27, wherein the sheet material flows a distance between the support platform and exit port.

31. The dispenser of claim 27, wherein the slot and adjustable orifice are positioned on a first axis, and the exit port is positioned on a second axis.

32. The dispenser of claim 31, wherein the sheet material positioned between the support platform and the exit port is disposed on a third axis.

33. A dispenser adapted to dispense sheet material, the dispenser comprising:

a housing including a platform having a slot therein configured to hold sheet material, the housing having an exit port spaced apart from the platform; and means positioned on the platform for controlling the movement of sheet material disposed in the housing through the exit port, the controlling means including an adjustable orifice wherein sheet material moving from the housing and through the exit port follows a generally S-shaped path which causes frictional resistance and assists in dispensing one sheet material at a time from the dispenser.

* * * * *